US007665818B2

(12) United States Patent
Yoshida

(10) Patent No.: US 7,665,818 B2
(45) Date of Patent: Feb. 23, 2010

(54) MULTIPASS IMAGE-FORMING DEVICE HAVING LARGE FEED CALIBRATION

(75) Inventor: Yasunari Yoshida, Ama-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 242 days.

(21) Appl. No.: 11/529,489

(22) Filed: Sep. 29, 2006

(65) Prior Publication Data

US 2007/0076035 A1 Apr. 5, 2007

(30) Foreign Application Priority Data

Sep. 30, 2005 (JP) ..... 2005-288361

(51) Int. Cl.
*B41J 29/38* (2006.01)
*B41J 2/145* (2006.01)

(52) U.S. Cl. ..... 347/16; 347/41; 347/104

(58) Field of Classification Search ..... 347/16
See application file for complete search history.

(56) References Cited

U.S. PATENT DOCUMENTS 6,331,038 B1 12/2001 Boleda et al.
6,764,157 B2 * 7/2004 Lee et al. ..... 347/16
6,769,759 B2 * 8/2004 Yamasaki et al. ..... 347/41
6,827,421 B2 12/2004 Nunokawa et al.
7,494,204 B2 * 2/2009 Otsuki ..... 347/16
2004/0075708 A1 * 4/2004 Arakawa ..... 347/19

FOREIGN PATENT DOCUMENTS

EP 0566318 A2 10/1993
EP 1211084 A1 6/2002
JP 2002-283543 10/2002
JP 2003-320719 11/2003

OTHER PUBLICATIONS

EP Search Report dtd Jan. 12, 2007, EP Appln. 06020418.7-1251.

* cited by examiner

*Primary Examiner*—Matthew Luu
*Assistant Examiner*—Shelby Fidler
(74) *Attorney, Agent, or Firm*—Banner & Witcoff, Ltd.

(57) ABSTRACT

An image-forming device forms an image having improving image quality by conveying a sheet in a nonuniform conveyance, and reduces a processing load required for calibrating a conveying length for the recording medium. In an image-forming device, a process for acquiring a theoretical conveying length for conveying a recording medium (S404) and for calibrating the theoretical conveying length (S409) is only executed for a large feed used to convey the recording medium a second conveying length greater than a first conveying length (S405: YES) and not for small feeds used to convey the recording medium the first conveying length (S405: NO). Since calibration is performed on the second conveying length, which is greater than the first conveying length, this method reduces a decline in precision for the conveying length of the recording medium, even when reducing the number of calibrations.

9 Claims, 11 Drawing Sheets

DEVIATION FROM IDEAL POSITION FOR UNDULATING INK EJECTION

UNIFORM CONVEYANCE (FOUR PASSES)

NONUNIFORM CONVEYANCE
(THREE SMALL FEEDS AND ONE LARGE FEED)

DEVIATION FROM IDEAL POSITION FOR UNDULATING INK EJECTION

UNIFORM CONVEYANCE (FOUR PASSES)

NONUNIFORM CONVEYANCE (THREE SMALL FEEDS AND ONE LARGE FEED)

MULTIPASS IMAGE-FORMING DEVICE HAVING LARGE FEED CALIBRATION

CROSS REFERENCE TO RELATED APPLICATIONS

This application claims priority from Japanese Patent Application No. 2005-288361 filed Sep. 30, 2005. The entire content of this priority application is incorporated herein by reference.

TECHNICAL FIELD

The present invention relates to an image-forming device, and particularly to an image-forming device capable of reducing a processing load required for calibrating a conveying length of the recording medium in order to improve image quality.

BACKGROUND

A conventional inkjet printer in the art repeatedly performs a recording operation to eject ink from a recording head to a sheet, while moving the recording head in a main scanning direction; and a conveying operation to convey the sheet in a subscanning direction orthogonal to the main scanning direction by means of a conveying device, in order to form images on the sheet. However, due to manufacturing tolerances in the recording head and conveying rollers of the conveying device used to convey the sheet, an incoincidence may occur between the actual conveying length and the theoretical conveying length. Therefore, this incoincidence is detected prior to shipping the inkjet printer, so that the theoretical conveying length can be calibrated depending on the incoincidence when an actual conveying operation is performed. Therefore, the sheet is fed by the calibrated conveying length to improve quality of the recorded image.

Japanese Patent Publication 2002-283543 discloses an inkjet printer which performs a non-uniform conveying operation for conveying the sheet by unequal conveying lengths for reducing an occurrence of banding (extraneous lines of ink) every time the recording head moves in the main scanning direction. In this inkjet printer, the calibration for conveying lengths is performed each time the sheet is conveyed. Accordingly, the sheet is always fed to a theoretical position.

However, the problem may arise that the calibration for each conveying length is a processing load to the recording operation.

An object of the invention is to provide an image-forming device which reduces a processing load to obtain high image quality.

SUMMARY

The invention provides an image-forming device having a recording unit, a conveying unit, and a control unit. The recording unit has a plurality of recording elements provided at a predetermined pitch in a subscanning direction. The recording unit is movable in a main scanning direction orthogonal to the subscanning direction. The plurality of recording elements is capable of forming a dot on a recording medium, respectively. The predetermined pitch corresponds to a predetermined resolution. The conveying unit conveys the recording medium in the subscanning direction alternately with a movement of the recoding unit in the main scanning direction. The control unit controls an operation of the conveying unit. The operation has a plurality of sequences which is identical to one another. Each of the plurality of sequences has n number (wherein n is a natural number) of small-feed modes and a single large-feed mode. The control unit selects a first distance in the small-feed mode. The control unit selects a second distance in the large-feed mode. The second distance is longer than the first distance. The control unit includes a calibrating unit that calibrates only the second distance to generate a corrected distance. The conveying unit conveys the recording medium by the first distance in the small-feed mode. The conveying unit conveys the recording medium by the corrected distance in the large-feed mode. Accordingly, an image having higher resolution than the predetermined resolution is formed on the recording medium.

BRIEF DESCRIPTION OF THE DRAWINGS

Illustrative aspects in accordance with the invention will be described in detail with reference to the following figures wherein.

DETAILED DESCRIPTION

Figure 1:
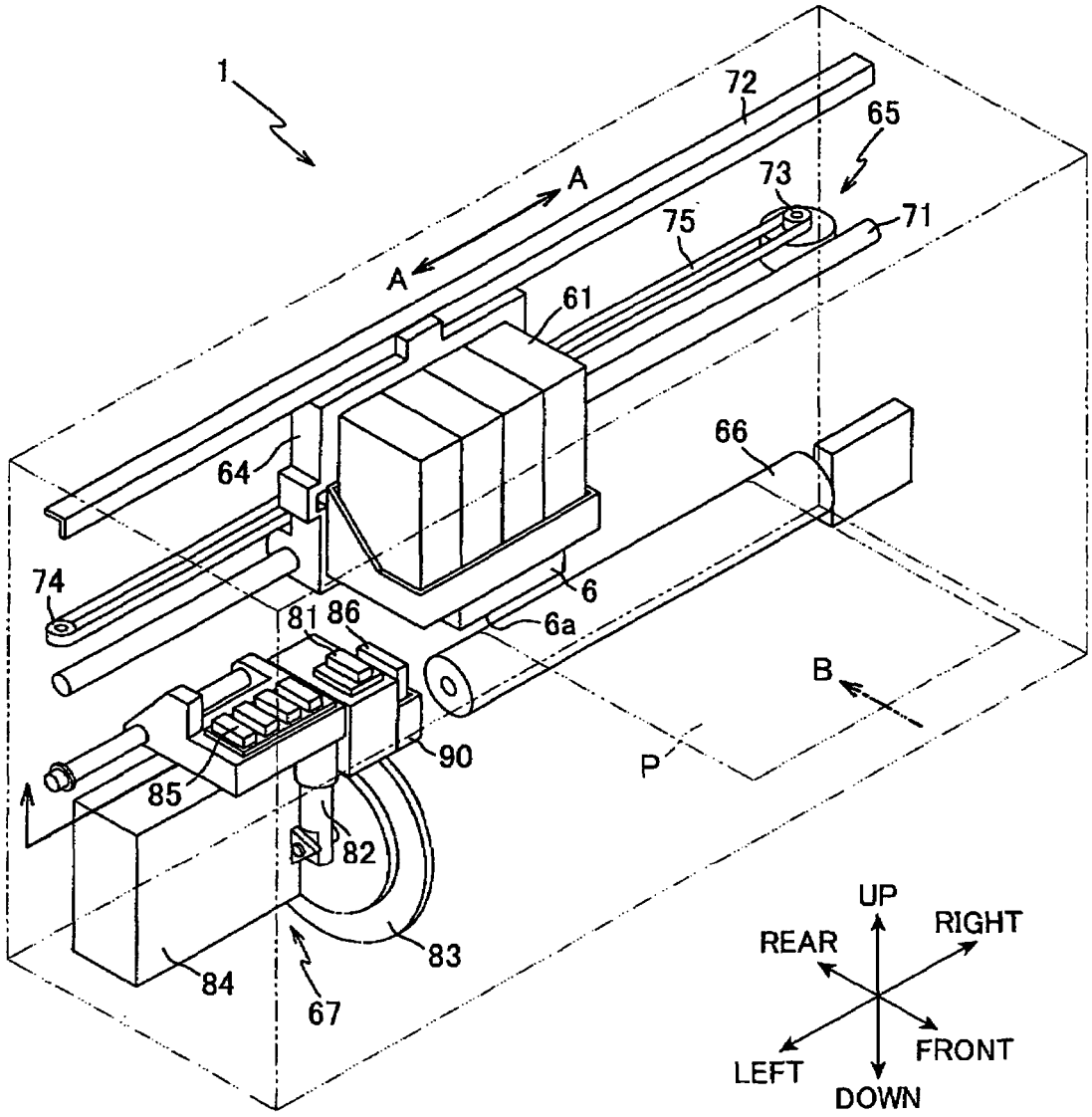
FIG. 1 is a perspective view showing a color inkjet printer according to illustrative aspects of the invention.

An inkjet printer according to some aspects of the invention will be described while referring to the accompanying drawings wherein like parts and components are designated by the same reference numerals to avoid duplicating description. The expressions "front", "rear", "above", "below", "right", and "left" are used throughout the description to define various parts when the inkjet printer is disposed in an orientation in which it is intended to be used.

Referring to FIG. 1, an inkjet printer 1 includes four ink cartridges 61 filled with one of the ink colors cyan (C), magenta (M), yellow (Y), and black (Bk), respectively; an inkjet head 6 for ejecting ink to a recording sheet P; the carriage 64 for supporting the ink cartridges 61 and the inkjet head 6 therein; a drive unit 65 for moving the carriage 64 in a reciprocating motion along a main scanning direction indicated by arrows A; a platen 66 extending in the main scanning direction A and opposing the inkjet head 6; and a purging device 67.

The drive unit 65 includes a carriage shaft 71 disposed on the lower end of the carriage 64 and extending parallel to the platen 66; a guide plate 72 disposed on the upper end of the carriage 64 and extending parallel to the carriage shaft 71; and two pulleys 73 and 74 disposed between the carriage shaft 71 and guide plate 72, with each of the pulleys 73, 74 being on each longitudinal end of the carriage shaft 71; and an endless belt 75 looped around the pulleys 73 and 74. A carriage return (CR) motor 16 (not shown in FIG. 1) drives the pulley 73 to rotate forward or in reverse. The carriage 64 is joined with the endless belt 75 to reciprocate along the carriage shaft 71 and guide plate 72 in the main scanning direction A along with the forward and reverse rotation of the pulley 73.

The inkjet printer 1 further includes a sheet cassette (not shown) and conveying rollers 60 (not shown in FIG. 1). A sheet P is fed from the sheet cassette and conveyed by the conveying rollers 60 between the inkjet head 6 and the platen 66 in a conveying direction B, i.e., a subscanning direction B. It should be noted that the subscanning direction B is orthogonal to the main scanning direction A.

With the above structure, the inkjet printer 1 performs a printing operation on the sheet P by ejecting ink from the inkjet head 6, while conveying the paper from the sheet cassette, and subsequently discharges the sheet P.

Figure 2:
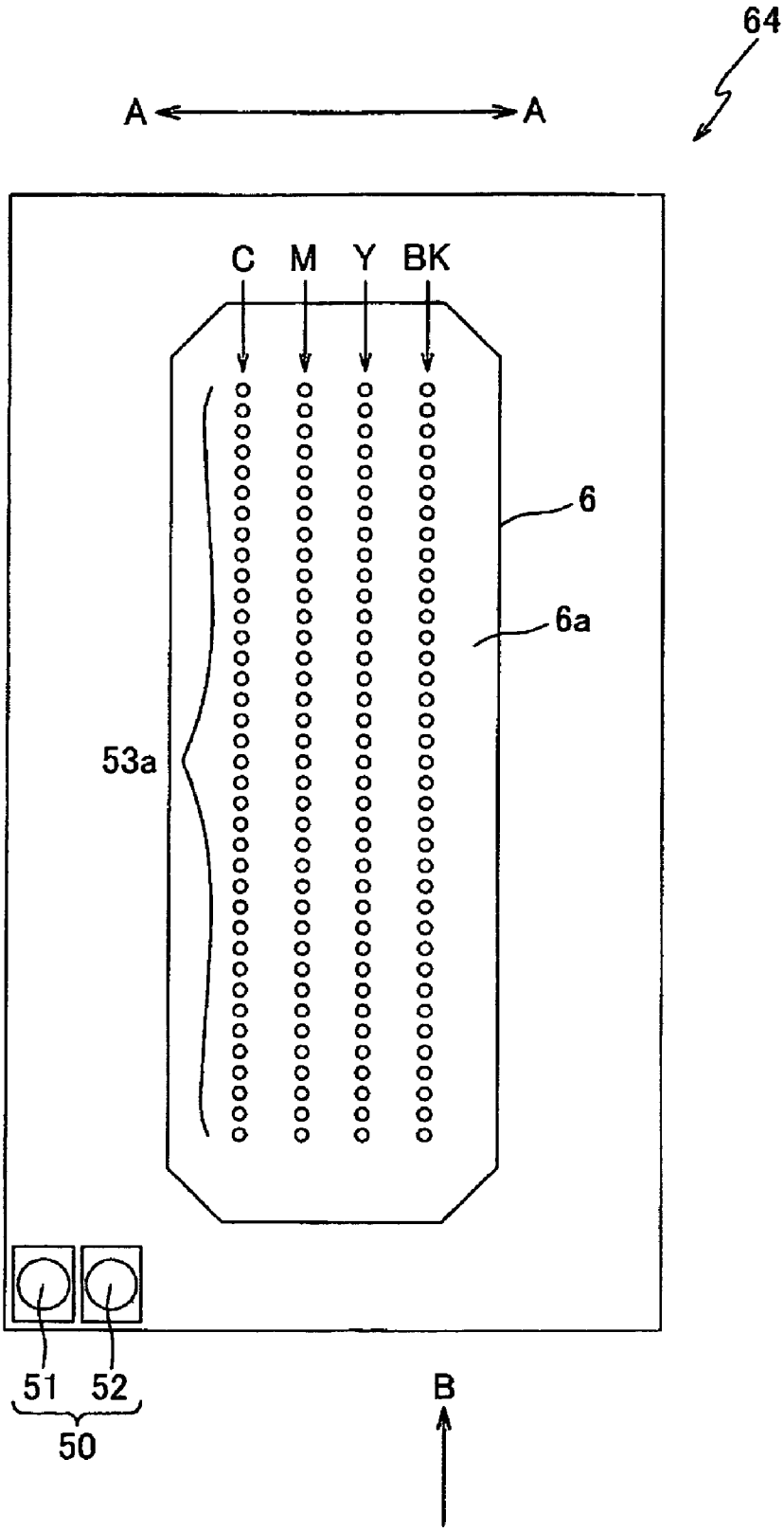
FIG. 2 is a bottom view of a carriage.

As shown in FIG. 2, the inkjet head 6 has a length of 1 inch in the subscanning direction B. The inkjet head 6 has a bottom surface 6*a* exposed from a bottom face of the carriage 64 to face the platen 66. Four columns of nozzles 53*a* are formed in the bottom surface 6*a*. Each column corresponds to one of the ink colors C, M, Y, and Bk. In this embodiment, the plural nozzles 53*a* constituting one column are aligned in the subscanning direction B at a predetermined density, i.e., at 150 dots per inch (dpi). However, it should be noted that the number and pitch of each column of the nozzles 53*a* is established depending on a desired resolution for printing the recorded image. The inkjet head 6 has piezoelectric actuators to eject ink through the nozzle 53*a*. It is also possible to increase or decrease the number of columns of nozzles 53*a l depending on the number of ink colors.*

As shown in FIG. 2, a media sensor 50 to detect the sheet P fed from the sheet cassette is mounted on the bottom surface of the carriage 64. The media sensor 50 includes a light-emitting element 51 configured of a photodiode, and a light-receiving element 52 configured of an optical sensor. The light-emitting element 51 emits light to the platen 66, while the light-receiving element 52 receives the reflected light. The media sensor 50 is mounted on the carriage 64 on an upstream side of the nozzles 53*a* in the subscanning direction. The media sensor 50 moves together the carriage 64 in the scanning direction.

An outer surface of the platen 66 is given a color such as black in order to have a lower reflectance from that of the sheet P. When the light-emitting element 51 emits light to the platen 66 without the sheet P being on, the light-receiving element 52 receives lower amount of reflected light from the platen 66. Accordingly, an output value outputted from the media sensor 50 is a lower value. On the other hand, when the sheet P is present on the platen 66, the light-receiving element 52 receives higher amount of reflected light from the sheet P having a higher reflectance, thereby generating a higher output value. Accordingly, it is possible to detect the existence of the sheet P based on the difference in the amount of reflected light received by the media sensor 50.

By mounting the media sensor 50 on the carriage 64 together with the inkjet head 6, it is not necessary to provide another carriage for scanning the media sensor 50, making it possible to form a more compact device. Further, by disposing the media sensor 50 on the carriage 64 upstream of the inkjet head 6 in the main scanning direction, the media sensor 50 can detect the left and right edge positions of the sheet P prior to image recording being performed on the sheet P.

The purging device 67 is disposed to one side of the platen 66 following the reciprocating direction of the carriage 64 and functions to restore ink ejection in the inkjet head 6. Ink ejection problems occur in the inkjet head 6 due to air bubbles produced in the ink and/or thickened ink. The purging device 67 serves to restore the inkjet head 6 to an appropriate ejection state.

The purging device 67 is positioned so as to oppose the inkjet head 6 when the carriage 64 is in a purging position. The purging device 67 includes a purge cap 81, a pump 82, a cam 83, and an ink reservoir 84. The purge cap 81 forms a hermetic seal over the bottom surface 6*a* of the inkjet head 6. The pump 82 draws out problematic ink containing air bubbles that has accumulated in the inkjet head 6. The pump 82 generates suction by rotating the cam 83 and moving a piston in the pump 82 in a reciprocating motion. By drawing out the problematic ink in this way, it is possible to restore the inkjet head 6 to an appropriate state. Ink drawn out of the inkjet head 6 is collected in the ink reservoir 84.

A wiper member 86 is disposed on the platen 66 side of the purge cap 81 and is capable of moving relative to the inkjet head 6. A cap 85 is positioned on the other side of the purge cap 81 from the wiper member 86. The wiper member 86 is formed of ethylene-propylene rubber or another elastic material in a plate shape. One end of the wiper member 86 is inserted into and supported by a wiper holder 90. The wiper member 86 protrudes to the inkjet head 6 so as to wipe ink that has accumulated on the bottom surface 6*a* of the inkjet head 6 as the carriage 64 moves. The cap 85 covers the nozzles 53*a* formed in the inkjet head 6 to prevent ink from evaporating.

Figure 3:
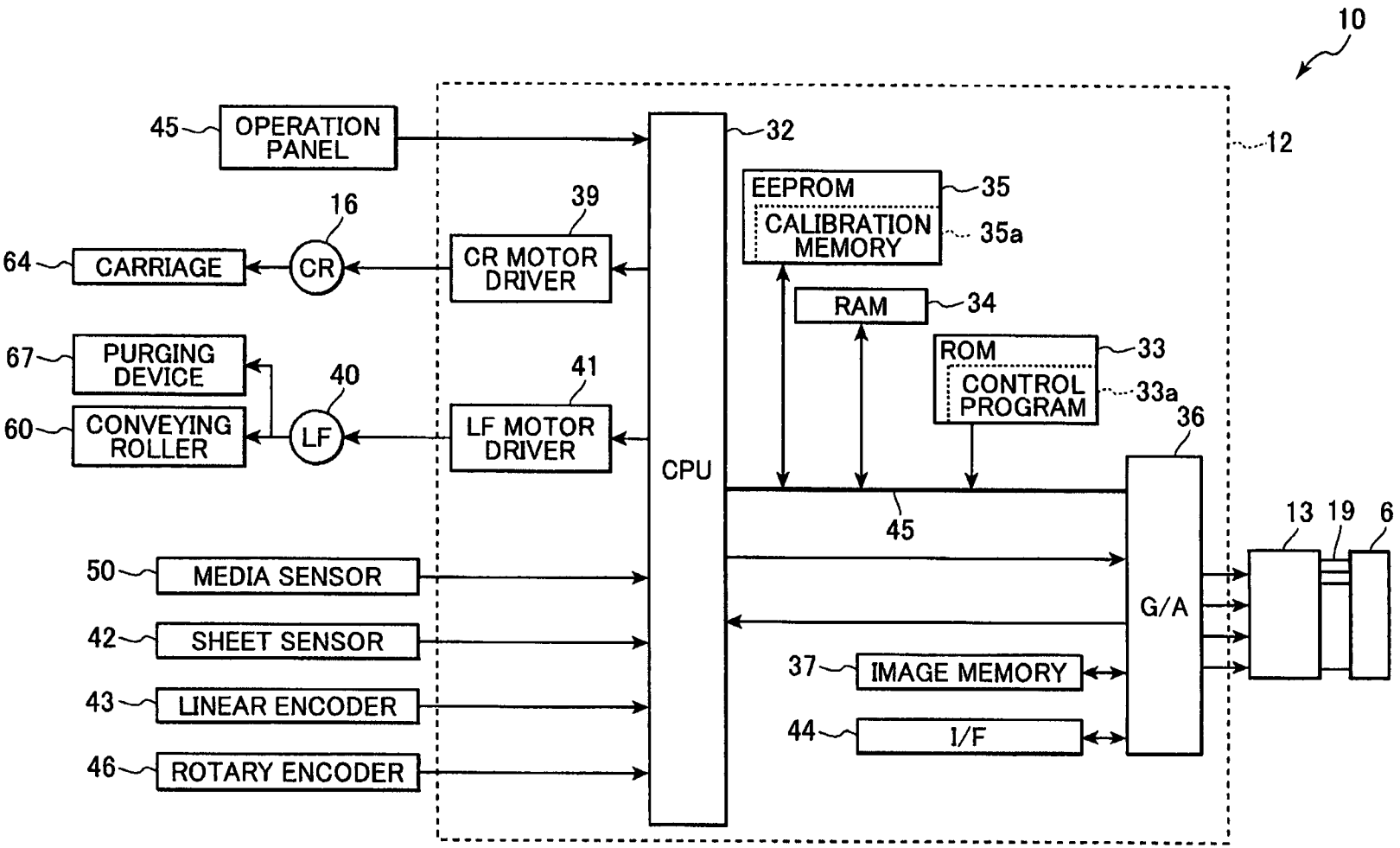
FIG. 3 is a circuit diagram showing the color inkjet printer.

Referring to FIG. 3, the inkjet printer 1 includes a controller 10 for controlling operations of the inkjet printer 1 including the movement of the carriage 64 and the feed of the sheet P. The controller 10 is configured of a main body control circuit board 12, and a carriage circuit board 13. The controller 10 includes a microcomputer (CPU) 32 having a single-chip structure; a ROM 33 for storing various control programs executed by the CPU 32 and data therefor; a RAM 34 for temporarily storing various data; an EEPROM 35; an image memory 37; and a gate array 36, which are mounted on the main body control circuit board 12.

The CPU 32 is an arithmetic computing device that generates a print timing signal and reset signal according to control programs prestored in the ROM 33, and transfers these signals to the gate array 36. The CPU 32 is also connected to a control panel 45 through which the user can issue print commands; a carriage return (CR) motor drive circuit 39 for driving the CR motor 16 to operate the carriage 64; a linefeed (LF) motor drive circuit 41 for activating a linefeed (LF) motor 40 for driving the conveying rollers 60 (and purging device 67); the media sensor 50; a sheet sensor 42; a linear encoder 43; and a rotary encoder 46. The CPU 32 controls the operations of all device connected thereto.

The sheet sensor 42 functions to detect a leading edge of the sheet P. The sheet sensor 42 is disposed upstream of the conveying rollers 60 and may be configured of a probe capable of rotating when contacted by the sheet P, and a photointerrupter for detecting the rotation of the probe. The linear encoder 43 functions to detect a moving amount of the carriage 64. The movement of the carriage 64 is controlled by detecting an output of the linear encoder 43 with a photointerrupter (not shown). The rotary encoder 46 functions to detect a rotary amount of the conveying rollers 60. The conveying rollers 60 are controlled by detecting an output of the rotary encoder 46 with a photointerrupter (not shown).

Hence, the rotary encoder 46 can detect an actual position of the sheet P conveyed by the conveying rollers 60 with a prescribed precision.

The ROM 33 stores a print control program 33*a* used to implement a page printing process. The EEPROM 35 includes a calibration memory 35*a*. Tests are performed prior to shipping the inkjet printer 1 to find a difference between the theoretical conveying length for conveying the sheet P and the actual conveying length of the sheet P conveyed by the theoretical conveying length. This difference is stored in the calibration memory 35*a*. The CPU 32, ROM 33, RAM 34, EEPROM 35, and gate array 36 are connected to each other via a bus line 45. Alternatively, the difference may be calculated or renewed based on the actual conveying length of the sheet P during an actual operation of the inkjet printer 1.

Based on a timing signal transferred from the CPU 32 and image data stored in the image memory 37, the gate array 36 generates recording data for recording this image data on the sheet P, a transfer clock synchronized with this recording data, a latch signal, a parameter signal for generating a signal having a basic drive waveform, and an ejection timing signal generated in a fixed cycle. The gate array 36 transfers these signals to the carriage circuit board 13.

The gate array 36 also receives image data transferred from a computer or other external device via an interface 44, such as a USB interface, and stores this image data in the image memory 37. Next, the gate array 36 generates a data reception interrupt signal based on data transferred from the computer via the interface 44 and transfers this signal to the CPU 32. A harness cable connects the gate array 36 to the carriage circuit board 13 for transferring the above different signals.

The carriage circuit board 13 has an inkjet head driving circuit mounted thereon to drive the inkjet head 6. The inkjet head 6 and the inkjet head driving circuit on the carriage circuit board 13 are electrically connected together through a flexible wiring board 19 having a copper foil wiring pattern formed on polyimide film with a thickness of 50-150 μm. The head driving circuit is controlled through the gate array 36 mounted on the main body control circuit board 12 to apply a drive pulse in a waveform suited to the recording mode to piezoelectric actuators in the inkjet head 6, thereby causing the inkjet head 6 to eject ink in prescribed amounts.

Figure 7:
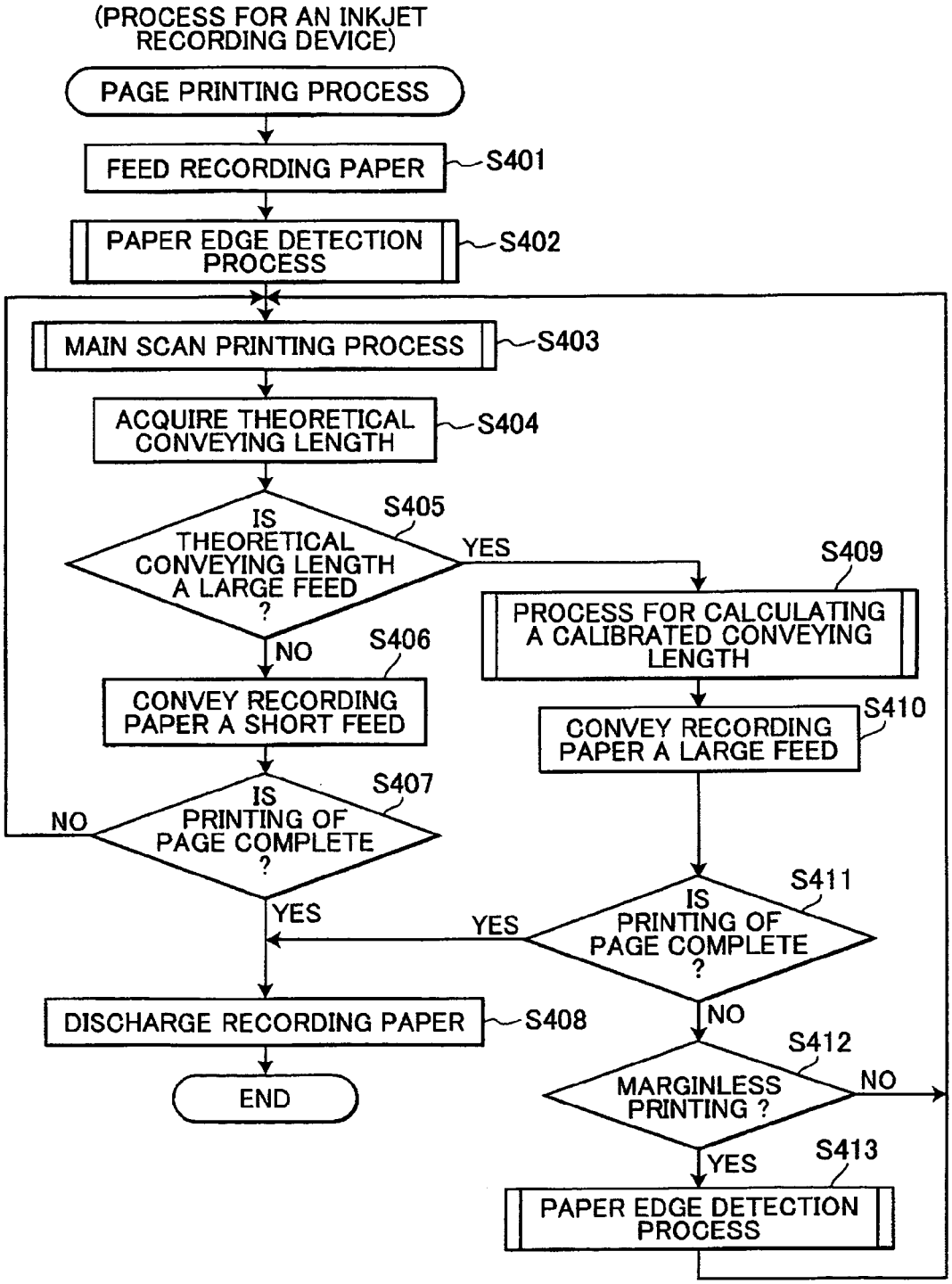
FIG. 7 is a flowchart illustrating a sheet printing process.

Next, recording operations of the inkjet printer 1 having the construction described above will be described with reference to FIGS. 7 through 12. Referring to FIG. 7, the CPU 32 executes a page printing process according to the print control program 33*a*. The page printing process is performed to form an image on one sheet by alternating a recording operation for ejecting ink to the sheet P with the inkjet head 6 moving in the main scanning direction once, and a conveying operation to convey the sheet P in the subscanning direction by a predetermined feed distance.

Figure 4A:
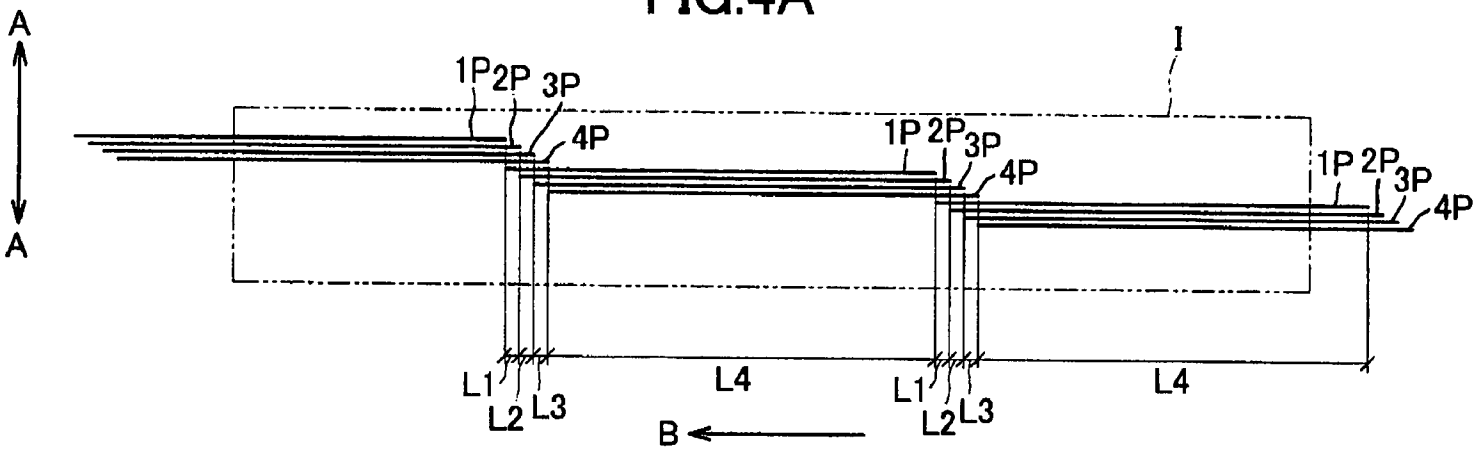
FIG. 4A illustrates a printed pattern provided by a non-uniform feed process.

The conveying operation for conveying the sheet P in this process is executed according to a nonuniform conveyance with reference to FIG. 4A. Specifically, the CPU 32 conveys the sheet P by repeating a series of conveying operations configured of small feeds for conveying the sheet P three times in the subscanning direction at first conveying lengths L1 through L3, and a large feed for conveying the sheet P one time at a second conveying length L4 greater than the first conveying lengths L1 through L3 after performing the small feeds. For comparison, uniform conveyance is shown in FIG. 4B.

The details of the nonuniform conveyance will be described with reference to FIGS. 4A and 4B.

Figure 4B:
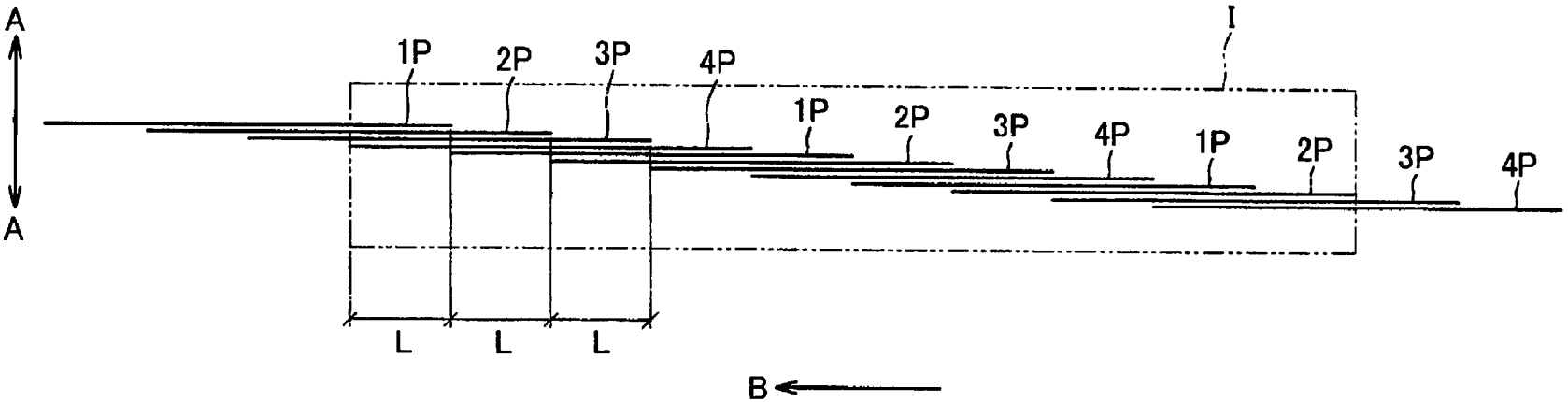
FIG. 4B illustrates a printed pattern provided by a uniform feed process.

In FIGS. 4A and 4B, arrows A indicate the main scanning direction, which is the reciprocating direction of the inkjet head 6, while the arrow B indicates the subscanning direction, which is the conveying direction of the sheet P. In this embodiment, a recording resolution of 600 dpi is required for a printing region I delineated by a rectangular broken line in FIGS. 4A and 4B. Hence, the movement of the inkjet head 6 needs four passes to obtain the required recording resolution. It should be noted that one pass means one printing operation of the inkjet head 6 in which the inkjet head 6 moves in one direction or in a reciprocation manner in the main scanning direction for printing the image on the sheet P within the length (1 inch) of the inkjet head 6. In FIGS. 10A and 10B, 1P designates an image formed during the first pass of the inkjet head 6, 2P an image formed during the second pass, 3P an image formed during the third pass, and 4P an image formed during the fourth pass.

As shown in FIG. 4B, uniform conveyance is a method for constantly conveying the sheet P a fixed conveying length L, i.e., ¼ inch after each pass of the inkjet head 6. On the other hand, nonuniform conveyance shown in FIG. 4A is a method of conveying the sheet P a conveying length L1 after the first pass, a length L2 after the second pass, a length L3 after the third pass, and a length L4 after the fourth pass. In the nonuniform conveyance, the sheet P is conveyed by a small feed three times, and then conveyed by a large feed after three small feeds in one sequence, i.e., in four passes. It should be noted that the number of conveyance by the small feed can be changed depending on a relation ship between the pitch of the nozzles and the desired resolution of the printed image.

For example, when 148 nozzles 53*a* formed at 150 dpi are used, the sheet P is conveyed to achieve three small feeds L1, L2, and L3 of 5/600 dpi and one large feed L4 of ((148·4−5·3)/600) dpi.

Figure 5A:
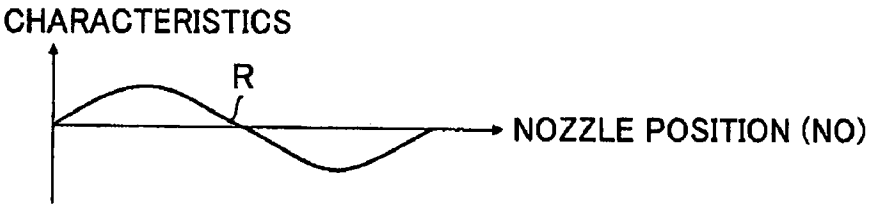
FIGS. 5A, 5B, and 5C show examples of uniform conveyance and nonuniform conveyance using a recording head having undulating ink ejection characteristics.
Figure 5B:
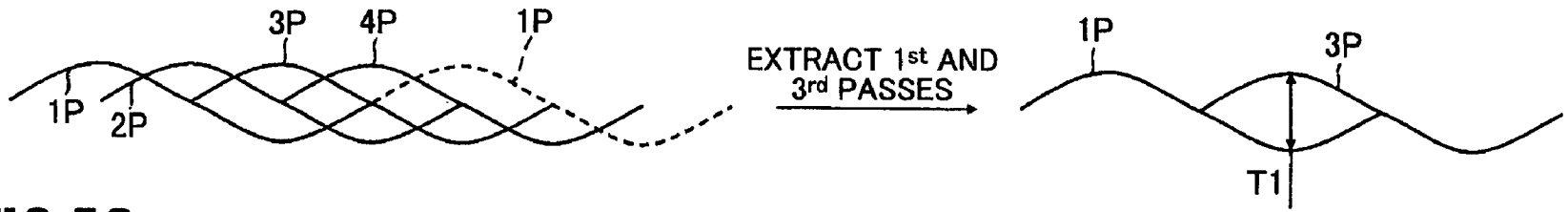
Figure 5C:
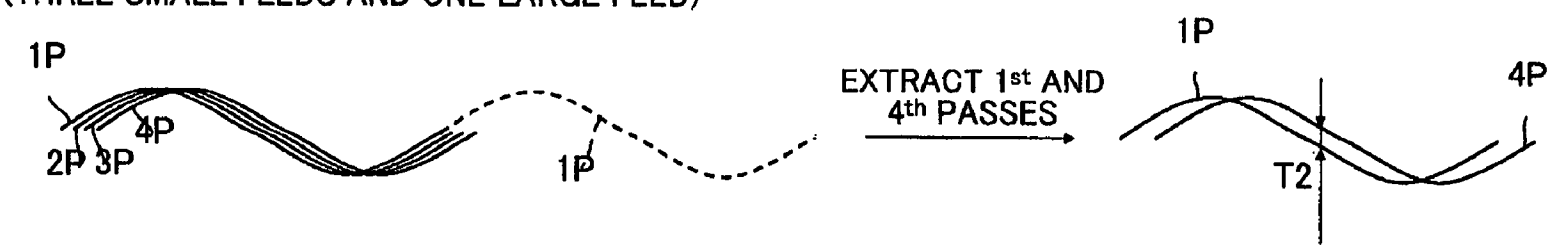

Referring to FIGS. 5A-5C, uniform conveyance and nonuniform conveyance using a inkjet head 6 having undulating ink ejection characteristics are shown.

As shown in FIG. 5A, a curve R indicates the ink ejection characteristics. When the nozzle position represented by the X-axis deviates from the ideal position represented by the Y-axis, the curve R is expressed as a curved shape approximating a sine curve, for example, rather than a straight line due to manufacturing tolerances in forming the nozzles and environmental factors.

During uniform conveyance, images 1P through 4P shown on the left side of FIG. 5B are formed as described in FIG. 4B. By extracting the images 1P and 3P, it can be seen that a gap T1 is formed between the two lines, as shown on the right side of FIG. 5B. This gap T1 contributes to banding.

On the other hand, images 1P through 4P shown on the left side of FIG. 5C are formed when performing nonuniform conveyance (see three small feeds and one large feed). When extracting the images 1P and 4P in this case, it can be seen that a gap T2 is formed between the two lines, as shown on the right side of FIG. 5C. Since the gap T2 is smaller than the gap T1 produced during the uniform conveyance in FIG. 5B, it is apparent that nonuniform conveyance can reduce the occurrence of banding.

Figure 6A:
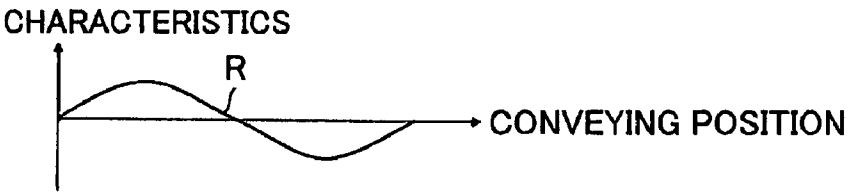
FIGS. 6A, 6B, and 6C show examples of uniform conveyance and nonuniform conveyance when the linefeed conveyance is undulating.
Figure 6B:
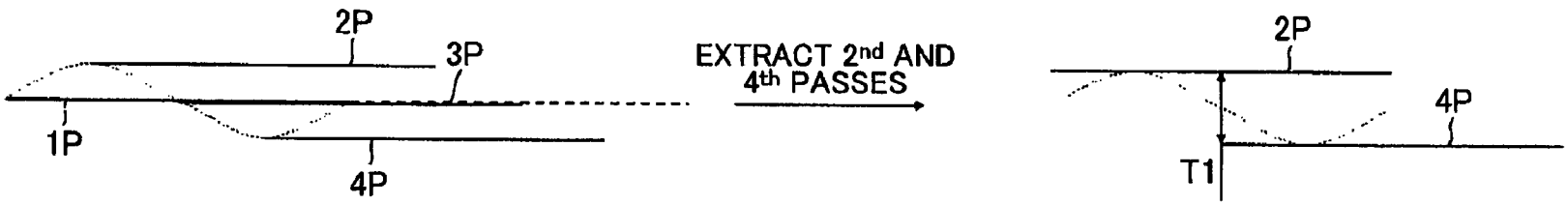
Figure 6C:
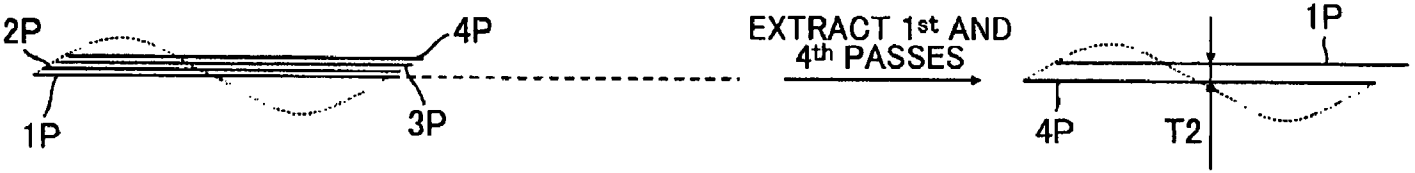

FIGS. 6A-6C show examples of uniform conveyance and nonuniform conveyance when the linefeed conveyance is undulating.

As shown in FIG. 6A, the curve R indicating the linefeed conveying characteristics is a curved line that approximates a sine curve, for example, rather than a straight line when the conveying position of the sheet P represented by the X-axis deviates from the ideal position represented by the Y-axis due to mechanical tolerances and friction of the sheet P.

In this case, images 1P through 4P shown on the right side of FIG. 6B are formed when performing uniform conveyance, as described in FIG. 4B. When the images 2P and 4P are extracted, it can be seen that a gap T1 is formed between the two lines, as shown on the right side of FIG. 6B.

On the other hand, images 1P through 4P shown on the left side of FIG. 6C are formed when performing nonuniform conveyance (three small feeds and one large feed). When the images 1P and 4P are extracted, it can be seen that a gap T2 is formed between the two lines, as shown on the right side of FIG. 6C. However, since the gap T2 is smaller than the gap T1 generated during uniform conveyance, it is apparent that nonuniform conveyance can reduce the occurrence of banding.

Referring to FIG. 4, the page printing process describes only steps performed after a computer connected to the inkjet printer 1 has transmitted print data to the inkjet printer 1. In addition to image data for recording an image, this print data includes sheet data indicating the type and size of the sheet P; and printing method data specifying normal printing with some margin or marginless printing. A printer driver installed on the computer in advance generates this print data.

In S401 of the page printing process, the CPU 32 begins feeding a sheet P after receiving the print data from the computer. More specifically, the CPU 32 drives the linefeed motor 40 in order to convey the sheet P accommodated in the sheet cassette to a printing position with a pickup roller, and the conveying rollers 60. In S402 the CPU 32 performs a process to detect the sheet edges. This sheet edge detecting process is executed regardless of whether the printing method is normal printing or marginless printing. The sheet edge detection process of S402 is performed to detect a sheet edge before printing. Edge data obtained by detecting the sheet edge in this process is stored in the RAM 34. In S403 a main scan printing process is performed to print the first pass based on the edge data stored in the RAM 34.

After printing the first pass (one linefeed width) according to the main scan printing process of S403, in S404 the CPU 32 obtains a theoretical conveying length needed to convey the sheet P to perform a linefeed. The theoretical conveying length is calculated as a theoretical conveying length Y for a small feed or a theoretical conveying length X for a large feed based on specifications of the inkjet head 6, and the required recording resolution specified in the print data. In this embodiment, four passes are required to print the image having the desired resolution. Accordingly, in one sequence constituting four passes, the CPU 32 is configured to obtain the theoretical conveying length for feed in the following manner. When the CPU 32 comes to S404 for the first time in one sequence, the CPU 32 sequentially obtains the theoretical conveying length Y for small feed three (3) times for the first through third passes, and after three times of obtaining the theoretical conveying length Y for small feed is over, the CPU 32 obtains the theoretical conveying length X for large feed for the last selection at the end of the sequence, i.e. for the fourth pass.

After obtaining the theoretical conveying length, the CPU 32 determines in S405 whether the acquired theoretical conveying length is the theoretical conveying length X for a large feed. If the obtained theoretical conveying length is not the theoretical conveying length X for a large feed (S405: NO), then in S406 the CPU 32 performs control to convey the sheet P the theoretical conveying length Y for a small feed. Specifically, the CPU 32 drives the conveying rollers 60 via the linefeed motor 40 in order to convey the sheet P exactly the theoretical conveying length Y. In this embodiment, the theoretical conveying length Y is 5/600 dpi. At this time, the rotary encoder 46 detects the rotated angular amount of the conveying rollers 60 and the CPU 32 detects the actual conveying length of the sheet P based on the encoder output.

After the sheet P is conveyed, the CPU 32 determines in S407 whether the entire page has been printed. If printing is completed (S407: YES) then in S408 the CPU 32 discharges the sheet P and the process ends. However, if the page has not been completed (S407: NO), then the CPU 32 returns to S403 and repeats the process starting from S403. Hence, in the main scan printing process of S403, once the CPU 32 obtains the theoretical conveying length Y for small feed for the first pass, the CPU 32 performs the steps from S403 to S407 three times. Accordingly, as described in FIG. 4A, images 1P through 3P are formed in this process.

However, when the CPU 32 determines in S405 that the obtained theoretical conveying length is the theoretical conveying length X for a large feed for the fourth pass (S405: YES), then in S409 the CPU 32 executes a process for calculating a calibrated conveying length for calibrating the theoretical conveying length X for a large feed. The process for calculating this calibrated conveying length in S409 cancels any difference between the theoretical conveying length X and the actual conveying length of the sheet P which has been conveyed by the theoretical conveying length X.

Generally when the conveying rollers 60 convey the sheet P the theoretical conveying length X, a difference often occurs between the theoretical conveying length X and the actual conveying length of the sheet P which has been conveyed by the theoretical conveying length X due to mechanical tolerances and environmental factors, or interference among components. Therefore, by calculating this difference in advance (preferably, prior to shipping the inkjet printer 1) and using a calibrated value capable of canceling this difference to correct the theoretical conveying length X, it is possible to convey the sheet P by a conveying length that approximates the theoretical conveying length X.

However, when the CPU 32 performs a small feed in S406, the CPU 32 conveys the sheet P by the theoretical conveying length Y for a small feed without calibrating the theoretical conveying length Y prior to performing a small feed. This is because the theoretical conveying length Y is considerably shorter than the theoretical conveying length X. Therefore, a difference between the theoretical conveying length Y and the actual conveying length of the sheet P which has been conveyed by the theoretical conveying length Y, even if the difference may occur, is not so serious as to affect the printed image quality, compared with the difference caused by the theoretical conveying length X. The process for calculating a calibrated conveying length in S409 is only executed prior to performing a large feed in S410.

Accordingly, the theoretical conveying length is calibrated only for a large feed when the large feed is performed after the sheet P is conveyed n (where n is a natural number) small feeds. In this embodiment, it is noted that n=3. In this way, it is possible to reduce the number of calibrations by not calibrating the conveying length each time the sheet P is conveyed, thereby reducing the processing load required for calibrating conveying lengths.

Further, since the calibration is performed only on the theoretical conveying length X for a large feed that is greater than the theoretical conveying length Y for a small feed, it is possible to prevent a significant decrease in the precision of conveying the sheet P, even when reducing the number of calibrations.

Specifically, as described with reference to FIG. 4A, since the first conveying lengths L1 through L3 for small feeds are sufficiently smaller than the second conveying length L4 for a large feed as to be negligible, the difference from the actual conveying amount when the theoretical conveying lengths L1 through L3 are not calibrated is also negligible, making it possible to convey the sheet P with substantially the same conveying accuracy as when performing calibrations each time the sheet P is conveyed. Therefore, it is possible to effectively improve image quality.

On the contrary, in the uniform conveyance as shown in FIGS. 4A and 5B, the process for calibrating the theoretical conveying length is required, because of constantly uniform feeds and the undulating ink ejection characteristics. Accordingly, the uniform conveyance for conveying the sheet P generates much process load to the operation of the inkjet printer 1, compared with the nonuniform conveyance.

Therefore, in S410 the CPU 32 conveys the sheet P the conveying length calibrated in the process for calculating a calibrated conveying length of S409, and determines in S411 whether the entire page has been printed. If printing of the page is completed (S411: YES), then the CPU 32 performs the process in S408 described above. However, if the page has not been completely printed (S411: NO), then the CPU 32 determines in S412 whether the printing method is marginless printing. If the method is marginless printing (S412: YES), then in S413 the CPU 32 executes a sheet edge detection process for detecting the sheet edge, and returns to S403. However, if the printing method is not marginless printing (S412: NO), then the CPU 32 returns to S403 without performing the process of S413.

Accordingly, the sheet edge detection process of S413 is performed to detect the sheet edge when performing marginless printing (S412: YES). In other words, the sheet edge detection process of S413 is only executed after the sheet P has been conveyed a large feed in S410.

Therefore, the sheet edge detection process of S413 is not executed after performing a small feed in S406, but only after performing the large feed in S410. As described with reference to FIG. 4A, the sheet edge detection process of S413 is not performed when the sheet P is being conveyed the three small feeds, even when performing marginless printing, but only when a single large feed is performed and only after performing the large feed.

Since the sheet edge detection process of S413 is only performed after conveying the sheet P a large feed and not after conveying the sheet P small feeds, it is not necessary to detect the sheet edge as many times as required when detecting the sheet edge each time the sheet P is conveyed. In other words, it is proper to detect the sheet edge only after the sheet is conveyed by the large feed. This is because when the sheet is conveyed by the small feed, the sheet is not conveyed so much as the large feed. Accordingly, any movement of the sheet edge conveyed by the small feed is not so large as a movement of the sheet edge conveyed by the large feed. Hence, it is possible to reduce the processing load required for detecting sheet edges. Further, since edge detection is only performed for the theoretical conveying length X for a large feed, which is greater than the theoretical conveying length Y for a small feed, the precision of sheet edge detection declines relatively little, even though fewer detections are performed.

Specifically, as described with reference to FIG. 4A, the first conveying lengths L1 through L3 for small feeds are sufficiently smaller than the second conveying length L4 for large feeds as to be negligible. Therefore, the act of not performing the sheet edge detection process of S413 after small feeds also has a negligible effect. Accordingly, it is possible to detect sheet edges with substantially the same precision as when detecting sheet edges each time the sheet P is conveyed.

Figure 8:
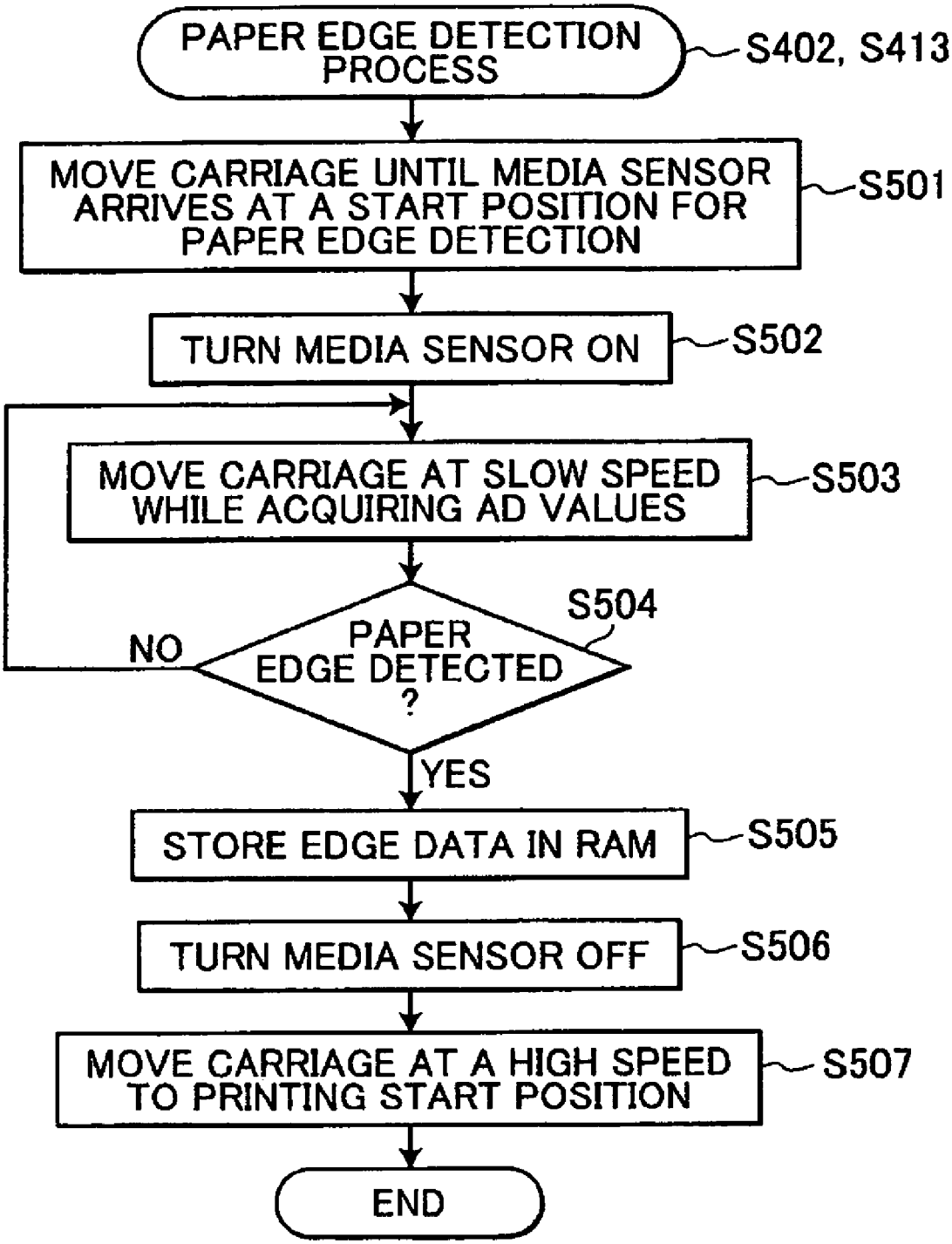
FIG. 8 is a flowchart illustrating a sheet edge detection process.
Figure 9:
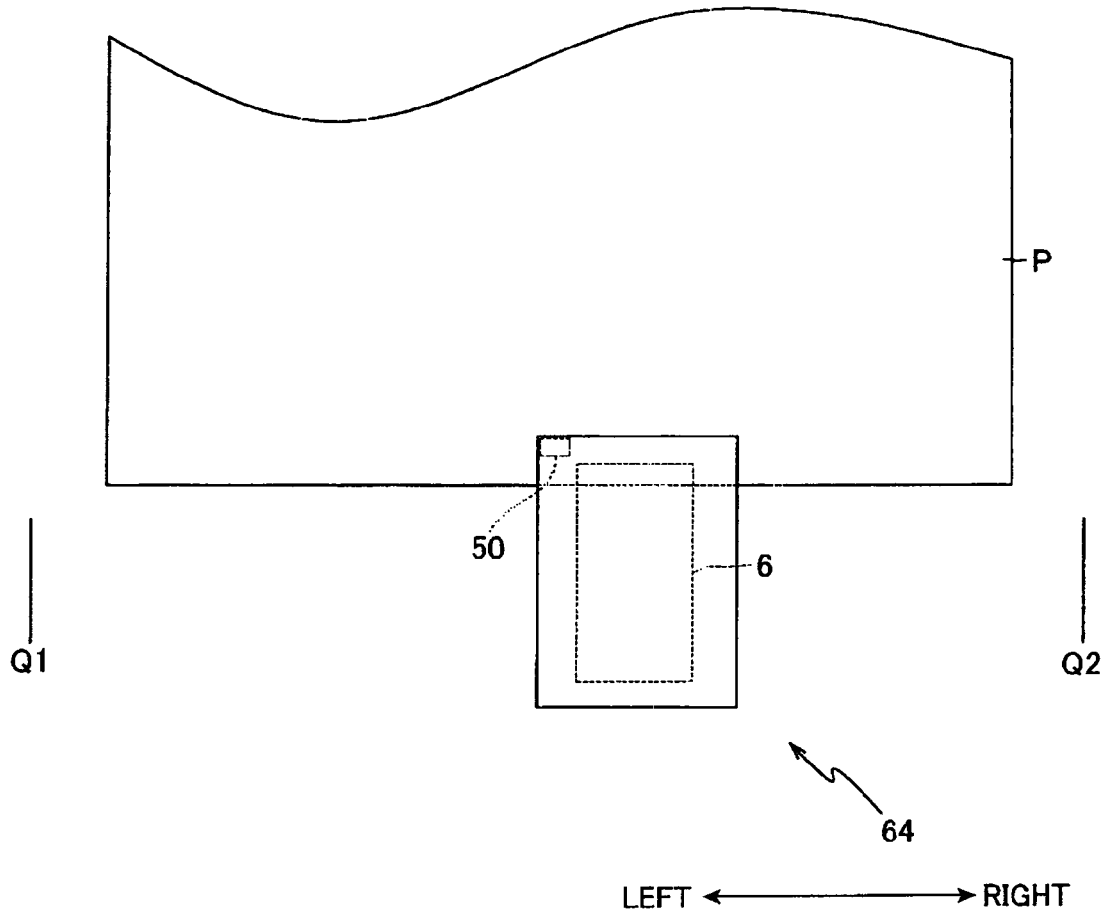
FIG. 9 is an explanatory diagram illustrating the carriage during the sheet edge detection process.

Next, the sheet edge detection process of S402 and S413 will be described in detail with reference to FIGS. 8 and 9. In S501 of the sheet edge detection process, the CPU 32 moves the carriage 64 until the media sensor 50 arrives at a start position for sheet edge detection. More specifically, the CPU 32 moves the carriage 64 to a start position Q1, which is outside the range of the sheet P, as shown in FIG. 9. The carriage 64 may be scanned bidirectionally in the left or right direction. In this embodiment, the carriage 64 is moved to the left side in FIG. 9.

In S502 the CPU 32 turns the media sensor 50 on. In S503 the CPU 32 moves the carriage 64 from the start position Q1 to the opposite side, that is, the right side in FIG. 9 at a slow first velocity, while continuously acquiring output values from the media sensor 50. In S504 the CPU 32 attempts to detect the sheet edge based on the acquired output values. The slow first velocity used at this time is a velocity that enables the media sensor 50 to detect the edges of the sheet P with accuracy.

In the media sensor 50, the light-emitting element 51 emits a light having an adjusted light intensity, and the light-receiving element 52 receives this reflected light. The output values outputted from the light-receiving element 52 are stored in the RAM 34 in association with an output of the linear encoder 43 for detecting the position of the carriage 64. The output values are generated from the media sensor 50 at a prescribed timing. If the carriage 64 is moved at a fast speed, moving the media sensor 50 at the fast speed, a single output value is generated from the media sensor 50 for every few pulse from the linear encoder 43. In other words, only a few values are sampled from the media sensor 50 over the widthwise dimension of the sheet P, resulting in poor detection accuracy.

However, since the carriage 64 is moved at a slow first velocity in this embodiment, the media sensor 50 mounted on the carriage 64 also moves at the slow first velocity. Therefore, a single output value is generated from the media sensor 50' for each encoder amount. In other words, a large number of output values can be sampled from the media sensor 50 over the widthwise dimension of the sheet P, thereby increasing the accuracy of edge detection.

More specifically, the output values generated from the light-receiving element 52 are a low first level when the sheet P is not present at a position opposing the media sensor 50, that is, when the light-receiving element 52 receives light reflected from the platen 66. The output values rise near the left edge of the sheet P. When the media sensor 50 is within the range of the sheet P, the light-receiving element 52 receives light reflected from the sheet P and generates output values of a high second level. The CPU 32 detects the position of the sheet edge at the position at which the output value reaches a detection threshold set between the first and second levels.

When the CPU 32 detects the left edge of the sheet P according to the method described above (S504: YES), in S505 the CPU 32 stores this left edge position as edge data in the RAM 34. In S506 the CPU 32 turns off the media sensor 50. In S507 the CPU 32 moves the carriage 64 to a printing start position Q2 at a fast second velocity, and the detection process ends.

In the method described above, the right edge of the sheet P in FIG. 9 is not detected after detecting the left edge. Instead, the CPU 32 moves the carriage 64 positioned over the sheet P to the printing start position Q2 at the fast second velocity. While the printing start position Q2 may be a position on either the left or right side of the sheet P, the printing start position Q2 is positioned on the right side in this embodiment. Further, the second velocity described above is faster than the slow first velocity since the media sensor 50 has been turned off and does not need generating output values at this time. Therefore, it is preferable to move the carriage 64 as fast as possible without consideration for detection precision, thereby shortening the time required for edge detection when compared to the method of scanning the media sensor 50 over the entire width of the sheet P.

Figure 10:
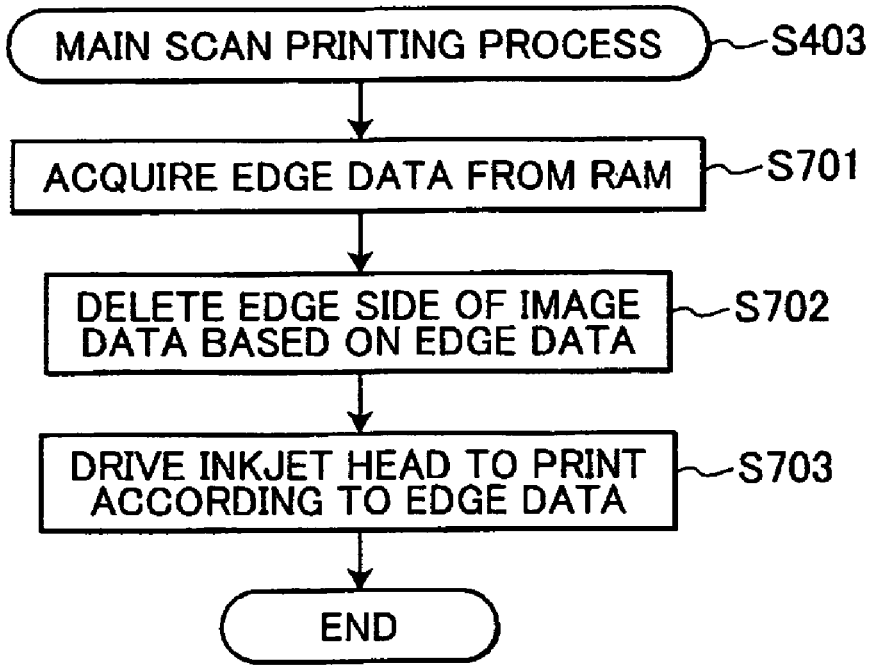
FIG. 10 is a flowchart illustrating a main scan printing process.
Figure 11:
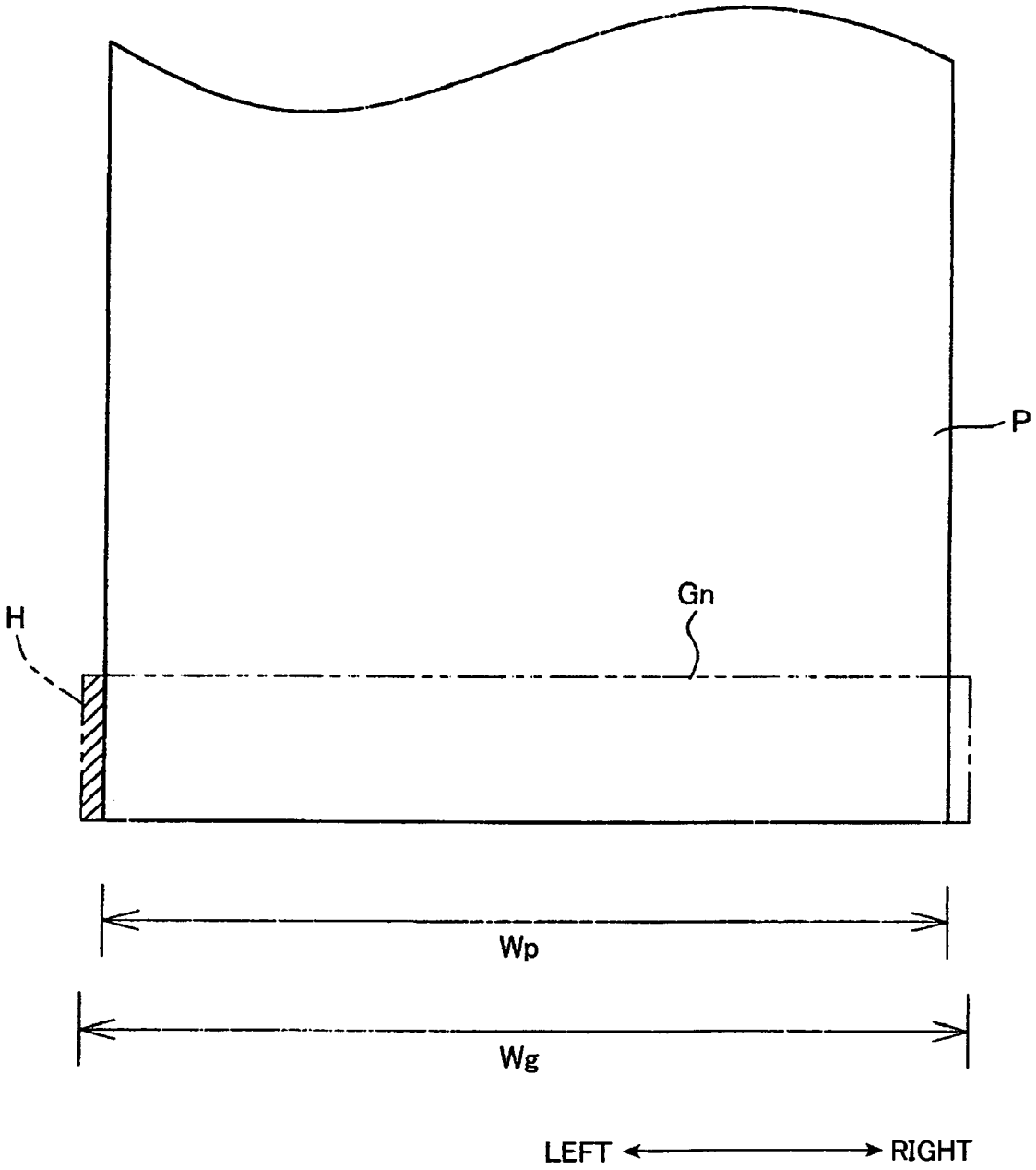
FIG. 11 is an explanatory diagram indicating a region H that has been deleted from image data Gn.

Next, the main scan printing process of S403 will be described in detail with reference to FIGS. 10 and 11. Referring to FIG. 10, in S701 of the main scan printing process, the CPU 32 reads edge data for the sheet P that was stored in the RAM 34 in S505 of FIG. 8. In S702 the CPU 32 deletes image data extending off the left edge of the sheet P based on the left edge position of the sheet P included in the edge data.

More specifically, image data is outputted as bands of image data Gn corresponding to one linefeed width. In the case of marginless printing, it is possible to avoid an occurrence of white areas on at least one of the edges of the sheet P on which printing is not performed, when a width Wg of the recorded image is enlarged based on the image data Gn slightly wider than a width Wp of the sheet P. However, if the width Wg of the recorded image is larger than the width Wp of the sheet P to a large extent, the inkjet head 6 will eject ink beyond the edges of the sheet P, soiling the platen 66 and potentially leading to the generation of an undesirable ink mist.

Hence, in this embodiment the CPU 32 deletes the region H extending beyond the left edge of the sheet P from the image data Gn or, in other words, prevents ink from being ejected from the inkjet head 6 for the portion of the image data Gn corresponding to the region H. In S703 the CPU 32 performs image recording on the left edge position of the sheet P. For the portion extending beyond the right edge of the sheet P, the CPU 32 performs image recording beyond the right edge of the sheet P. In this way, it is possible to perform accurate image recording to the left edge of the sheet P by deleting the region H extending beyond the left edge. However, since image data extending beyond the right edge of the sheet P is printed, it is possible to prevent white spaces from appearing along the right edge. In this way, the image data Gn for one linefeed width is completed.

Figure 12:
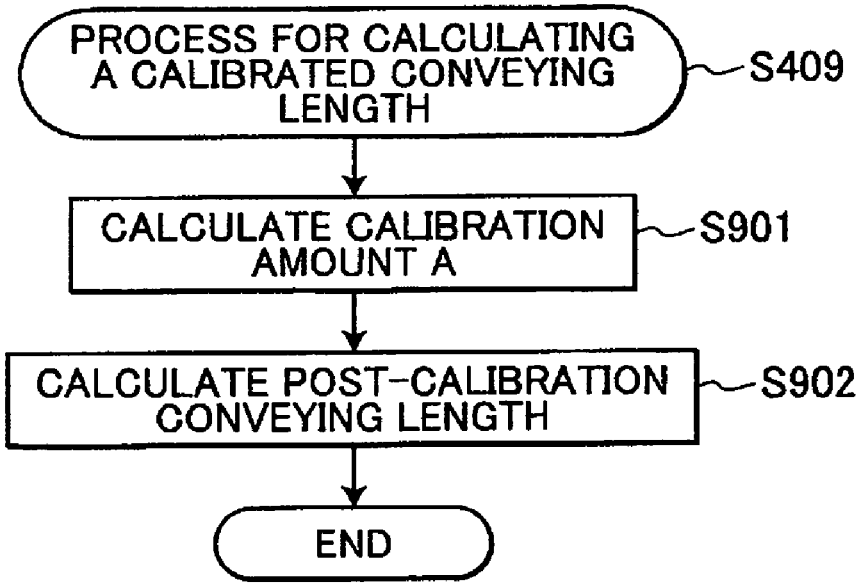
FIG. 12 is a flowchart illustrating a process for calculating a feed length.

Next, the process for calculating a calibrated conveying length of S409 will be described in detail with reference to FIG. 12. Referring to FIG. 12, in S901 of the calculation process, the CPU 32 first calculates a calibration amount A. The calibration amount A is calculated based on equation (1) shown below, where $\alpha$ is the amount of difference between the theoretical conveying length for conveying the sheet P and the actual conveying length corresponding to this theoretical conveying length, and $\gamma$ represents the detection precision of the rotary encoder 46. The difference $\alpha$ is stored in the calibration memory 35*a* of the EEPROM 35.

$$A=\gamma\cdot\mathrm{int}((\alpha/\gamma)+0.5) \quad (1)$$

The calibration amount A can also be calculated based on the following equation (2) that does not include 0.5 to be added to $\alpha$, as is included in equation (1).

$$A=\gamma\cdot\mathrm{int}(\alpha/\gamma) \quad (2)$$

Here, equation (1) and equation (2) will be compared for an example in which the difference $\alpha$ is 9.7 μm, and the rotary encoder 46 has a precision capable of detecting a conveying position in units of 10 μm. In this example, A=10 μm when using equation (1) and A=0 μm when using equation (2). Hence, it is possible to select one of two different calibration amount A which is closer to the difference $\alpha$. In other words, even if the rotary encoder 46 does not have a high detection precision $\gamma$, it is possible to reduce precision-dependent error.

After calculating the calibration amount A in S901, in S902 the CPU 32 can calculate a post-calibration conveying length for a large feed by adding the theoretical conveying length to this calibration amount.

While the invention has been described in detail with reference to specific embodiments thereof, it is be apparent to those skilled in the art that many modifications and variations may be made therein without departing from the spirit of the invention, the scope of which is defined by the attached claims.

For example, when different lengths for small feeds are used for conveying the sheet P, it is possible to make at least one of the conveying lengths different rather than keeping all conveying lengths the same. For example, if the ink ejection characteristics can be represented by a curved line formed by distorting a sine curve, as shown in FIG. 5A, it is possible to improve image quality by setting the conveying lengths for small feed based on these characteristics, rather than setting the conveying lengths for all small feeds the same. As described above, changing the small feed for respective one of the first through third passes depending on the undulating ink ejection characteristics leads to the improvement of the printed image quality which is not affected by the ink ejection characteristics.

In the above description, the image-forming device is a color inkjet printer. However, the present invention may also be applied to a dot impact printer and thermal printer. In this case, the same advantages and effects are expected for the dot impact printer or the thermal printer.

In the above embodiment, fewer calibrations are need than when calibrating the conveying length each time the recording medium is conveyed. Hence, it is possible to reduce the processing load for calibrating the conveying length and to reduce the time period required for calibrating the conveying length, thereby increasing the speed of the image recording. Further, since calibration is merely performed for the large feed conveying length that is greater than the small feed conveying length, this method prevents a decline in conveying precision, even when reducing the number of calibrations. Accordingly, the present invention effectively improves image quality.

In the above embodiment, it is possible to improve image quality by setting the large feed conveying lengths to compensate for deviations in the ideal nozzle positions and deviations in the ideal conveying positions.

In the above embodiment, it is possible to reflect the detection precision of the rotary encoder to detect the actual conveyed length of the sheet in the calibration amount for the theoretical conveying length.

In the above embodiment, a fewer number of edge detections is required when detecting the edge of the recording medium each time the recording medium is conveyed. Hence, it is possible to reduce the processing load required for detecting the edge of the recording medium and to reduce the time period required for detecting the edge, thereby increasing the image recording speed. Further, since the edge of the recording medium is detected when conveying the recording medium one time by the second conveying length, which is greater than the first conveying length, it is possible to prevent a drop in edge detecting precision, even when reducing the number of detections.

In the above embodiment, the media sensor is reciprocated in the main scanning direction together with the recording means without requiring a separate mechanism for reciprocating the media sensor in the main scanning direction, thereby enabling the device to be made more compact and preventing an increase in manufacturing costs.

What is claimed is:

1. An image-forming device comprising:

a recording unit having a plurality of recording elements provided at a predetermined pitch in a subscanning direction, the recording unit being movable in a main scanning direction orthogonal to the subscanning direction, the plurality of recording elements being configured to form a dot on a recording medium, respectively, the predetermined pitch corresponding to a predetermined resolution;

a conveying unit that conveys the recording medium in the subscanning direction alternately with a movement of the recording unit in the main scanning direction; and a control unit that controls an operation of the conveying unit, the operation comprising a plurality of sequences, the plurality of sequences being identical to one another, each of the plurality of sequences comprising n number (wherein n is a natural number) of small-feed mode conveying distances and a single large-feed mode conveying distance, the control unit selecting a first distance in the small-feed mode, the control unit selecting a second distance in the large-feed mode, the second distance being longer than the first distance, the control unit comprising a calibrating unit that performs a plurality of calculations for calibrating, sequence by sequence, only the second distance to generate a plurality of corrected distances, wherein the conveying unit conveys the recording medium by the first distance in the small-feed mode, and the conveying unit conveys the recording medium by a corresponding one of the plurality of corrected distances in the large-feed mode to form an image having higher resolution on the recording medium than the predetermined resolution.

2. The image-forming device according to claim 1, wherein the control unit is configured to change the first distance responsive to the control unit selecting the first distance.

3. The image-forming device according to claim 1, wherein the control unit further comprises:

a data unit that obtains a difference between the second distance and an actual conveyed distance of the recording medium based on the second distance; and a storage unit that stores the difference, and wherein the calibrating unit calculates the corrected distance to calibrate the second distance based on the difference.

4. The image-forming device according to claim 3, further comprising a detecting unit that detects the actual conveyed distance of the recording medium conveyed by the conveying unit with a predetermined accuracy, wherein the calibrating unit calculates the correction distance based on a following equation, $$A=\gamma\cdot\mathrm{int}((\alpha/\gamma)+0.5)$$

wherein A is the correction distance, $\alpha$ is the difference, and $\gamma$ is the predetermined accuracy, the correction distance is added to the second distance, thereby obtaining the plurality of corrected distances.

5. The image-forming device according to claim 4, wherein the conveying unit comprises a conveying roller that conveys the recording medium in the subscanning direction, and the detecting unit comprises a rotary encoder configured to detect a rotation amount of the conveying roller.

6. The image-forming device according to claim 1, wherein each of the plurality of recording elements is a nozzle to eject ink therethrough.

7. The image-forming device according to claim 1, wherein the recording unit comprises:

a carriage; and a recording head supportable by the carriage, the recording head being provided with a plurality of nozzles to eject ink therethrough.

8. The image-forming device according to claim 1, wherein the calculation by the calibrating unit is performed before the recording medium is conveyed in the large-feed mode.

9. An image-forming device comprising:

a recording unit having a plurality of recording elements provided at a predetermined pitch in a subscanning direction, the recording unit being movable in a main scanning direction orthogonal to the subscanning direction, the plurality of recording elements being configured to form a dot on a recording medium, respectively, the predetermined pitch corresponding to a predetermined resolution;

a conveying unit that conveys the recording medium in the subscanning direction alternately with a movement of the recording unit in the main scanning direction; and a control unit that controls an operation of the conveying unit, the operation comprising a plurality of sequences comprising a small-feed mode and a large-feed mode, the control unit selecting a first distance in the small-feed mode, the control unit selecting a second distance in the large-feed mode, the second distance being longer than the first distance, the control unit comprising a calibrating unit that performs a plurality of calculations for calibrating, sequence by sequence, only the second distance to generate a plurality of corrected distances, wherein the conveying unit conveys the recording medium by the first distance in the small-feed mode, and the conveying unit conveys the recording medium by a corresponding one of the plurality of corrected distances in the large-feed mode to form an image having higher resolution on the recording medium than the predetermined resolution.

* * * * *